US006308345B1

(12) United States Patent
Williams, Jr.

(10) Patent No.: US 6,308,345 B1
(45) Date of Patent: Oct. 30, 2001

(54) HEADREST FOR WORKERS, BELAYERS OR PHYSICALLY IMPAIRED PERSONS

(76) Inventor: James D. Williams, Jr., P.O. Box 1311, Homer, AK (US) 99603

( * ) Notice: Subject to any disclaimer, the term of this patent is extended or adjusted under 35 U.S.C. 154(b) by 0 days.

(21) Appl. No.: 09/455,142

(22) Filed: Dec. 6, 1999

(51) Int. Cl.[7] ..... A41D 13/00; A61F 5/00

(52) U.S. Cl. ..... 2/468; 2/467; 602/16; 602/17

(58) Field of Search ..... 2/468, 455, 467, 2/410, 421, 44, 327; 602/16–20; 182/3–5

(56) References Cited

U.S. PATENT DOCUMENTS

| | | | | |
|---|---|---|---|---|
| 15,581 | | 8/1856 | Slaughter . | |
| 72,467 | | 12/1867 | Dunlap . | |
| 138,463 | | 4/1873 | Wright . | |
| D. 259,689 | | 6/1981 | Handel | D6/200 |
| D. 304,987 | | 12/1989 | Libenson | D6/601 |
| 382,949 | | 5/1888 | Campbell . | |
| 392,212 | | 11/1888 | McCollum . | |
| 1,463,081 | | 7/1923 | Hancock . | |
| 3,480,976 | | 12/1969 | Yavner | 5/338 |
| 3,657,739 | | 4/1972 | Holmes, Sr. | 2/2 |
| 4,236,264 | | 12/1980 | Britzman | 5/435 |
| 4,285,081 | | 8/1981 | Price | 5/434 |
| 4,345,347 | | 8/1982 | Kantor | 5/441 |
| 4,449,251 | | 5/1984 | Gauthier | 2/2 |
| 4,560,201 | | 12/1985 | Scott | 297/393 |
| 4,565,408 | | 1/1986 | Palley | 297/393 |
| 4,593,788 | * | 6/1986 | Miller | 182/3 |
| 4,617,691 | | 10/1986 | Monti et al. | 5/434 |
| 4,679,262 | | 7/1987 | Davis et al. | 5/434 |
| 4,679,263 | | 7/1987 | Honer | 5/437 |
| 4,738,488 | | 4/1988 | Camelio | 297/393 |
| 4,870,705 | | 10/1989 | Higby et al. | 2/2 |
| 4,881,529 | | 11/1989 | Santos | 128/75 |
| 4,951,337 | | 8/1990 | Hull et al. | 5/434 |
| 5,129,705 | | 7/1992 | Wray | 297/397 |
| 5,220,700 | | 6/1993 | Liu | 5/636 |
| 5,411,471 | * | 5/1995 | Terrazas | 602/18 |
| 5,483,698 | * | 1/1996 | Douglas | 2/455 |
| 5,840,051 | * | 11/1998 | Towsley | 602/19 |
| 5,978,961 | * | 11/1999 | Barker | 2/2.5 |
| 6,009,566 | * | 1/2000 | Hubbard | 2/468 |

* cited by examiner

*Primary Examiner*—John J. Calvert
*Assistant Examiner*—Tejash Patel
(74) *Attorney, Agent, or Firm*—Thomas, Kayden, Horstemeyer & Risley

(57) ABSTRACT

The headrest provides support to the person's head, thereby relieving neck fatigue and other various discomforts. A one-piece headrest (10) is formed as a single piece and includes a back mounted support plate (14) having concave central body portion (16) and side wings (17 and 18) which straddle the person's spine to increase comfort, reduce movement of the head rest, and increase stability of the back mounted support plate when attached to the person's upper back. The second embodiment is a two-piece headrest (110) that includes a separate head support portion (120) and a back mounted support plate (114). The head support portion is pivotally connected to the back mounted support plate and a spring (125) urges the head support portion toward the person's head so that support can be provided to the person's head over a continuous angle range of backwardly tilted head positions. A locking mechanism (130) can be provided which enables the person to fix the angular position of the head support portion (112). Three strap systems have been developed for use by individuals using the headrest for different applications; belayers wearing a belayer's climbing harness, workmen wearing a tool belt attached to the waist, and persons using leg straps. The straps releasably attach to the climbing harness, tool belt or leg straps.

27 Claims, 5 Drawing Sheets

HEADREST FOR WORKERS, BELAYERS OR PHYSICALLY IMPAIRED PERSONS

FIELD OF THE INVENTION

This invention relates generally to headrest devices and the like which are used by workmen and belayers when working in a position in which they must hold their heads in a backward tilted position for extended periods, or by physically impaired persons lacking motor skills controlling head position.

BACKGROUND OF THE INVENTION

When a person is looking forward, the center of gravity of the person's head is above and approximately in vertical alignment with the person's spine. With the person's head in this forward looking position, the weight of the person's head is supported by the spine, much like a column supports the weight of a building roof. However, when the person is looking upwards, the person's head will tilt backwardly and move the person's head out of vertical alignment with the spine. When the head is tilted backwards, the center of gravity of the head moves rearwardly of the spine and the person's neck muscles must support the weight of the head. Supporting the head in this backward tilted position requires more energy and effort from the neck muscles than is normally required when holding the head in an upright, forward looking position. If the person is looking upward for extended periods, the additional energy and effort expended by the neck muscles will soon result in discomfort and fatigue as the neck muscles begin to tire.

Headrests have been developed and used by people who must look upwardly for extended periods. These prior art headrests have been used by plasters, travelers, and mechanics who must hold their heads in a backward tilted position for extended periods. The primary purpose of these prior art headrests has been to provide the necessary head support to reduce neck fatigue. These prior art headrests usually rest on and derive support from the person's shoulders, or, are attached to the person's belt. Prior art headrests attaching to the person's belt may not be comfortable if the belt is pulled upwards and purchases itself under the person's ribs restricting the diaphragm, or if the person's pants are elevated until the pants crotch finds purchase on the body.

Recreational sporting activities can require the participant to look upward for extend periods. For example, when rock or mountain climbing or mountaineering, a belayer is responsible for the climbers safety by feeding the proper amount of rope to the climber through a friction creating device attached to the belayers harness. Maintaining the proper amount of rope tension requires that the belayer keep the climber in eye contact whenever possible. Since the climber moves upward from the belayers position, the belayer is required to keep the head tilted backward at a sever angle for extended periods of time.

Some individuals have difficulty or require assistance in holding their heads in a vertical position. For example, individuals with physical disabilities, people recovering from neck or head injury, or people suffering from chronic muscle spasms may require neck and/or head support.

Several key features have been lacking in these prior art headrests. One lacking feature is the construction of a headrest which provides adequate support to the back of the neck and the head, and which can be securely and comfortably mounted to the person. Another feature lacking in some prior art headrests is a simple construction of only one or two pieces, thereby minimizing the cost of production and simplifying the assembly process. Another lacking feature is a headrest which provides support at a selectable angle, or over a continuous angle range of backwardly tilted head positions. Also, many of the prior art head supports do not provide a back mounted support plate which is contoured or shaped to the person's shoulder blades, nor do the prior art back mounted support plates provide a space for the person's spinal cord, which would minimize discomfort to the person, reduce movement of the head support, and increase stability of the back mounted support plate when attached to the person's back.

SUMMARY OF THE INVENTION

The present invention relates to a headrest used by a person who must hold their head in a backwardly tilted position for extended periods. Such a person could be a workman who works with their head tilted backwardly, or a belayer who looks upwardly while attending the ropes used by a climber, or an individual with a physical disability or injury. The headrest provides support to the person's head, thereby relieving neck fatigue and other various discomforts.

Generally, a one-piece embodiment of the headrest is comprised of a back mounted support plate adapted to fit to the person's upper back and shoulders, a head support portion adapted to support the person's head, and a means for attaching the back mounted support plate to the person's upper back, such as a strap attachment system. In one embodiment, the headrest is unitarily formed from a moldable polymeric material so as to be easy and inexpensive to manufacture. The central body portion of the back mounted support plate has a concave surface which straddles the person's spine to increase comfort, to reduce movement of the head rest, and to increase stability of the back mounted support plate when attached to the person's upper back. Support to the person's head is provided by the head support portion which extends outwardly from the back mounted support plate. A head cushion may be affixed to the head support portion for extra comfort.

In a second embodiment, the headrest is comprised of a separate head support portion and a separate, back mounted support plate. The head support portion is pivotally connected to the back mounted support plate and a coil torsion spring functions as a biasing means to urge the head support portion toward the person's head so that contact can be maintained with the person's head over a continuous angle range of backwardly tilted head positions. A locking mechanism is provided which enables the person to fix the angular position of the head support portion.

The described headrest embodiments utilize a system of straps, threaded through strap slots in the wing portions of the back mounted support plate, to attach the headrest to the person's upper back and shoulders. Stability of the headrest is improved when the strap slots on the right wing portion are separated by at least six inches from the strap slots on the left wing portion. Three strap configurations have been developed for use by individuals using the headrest for different applications; belayers wearing a belayer's climbing harness, workmen wearing a tool belt attached to the waist, workers not wearing a tool belt, and physically impaired persons lacking motor skills controlling head position. These three embodiments rely on one of two means to offset the force exerted on the headrest when the weight of the head is supported by the headrest. One of these two means of support is a counter weight and more specifically the tool belt already worn by the worker and loaded with tools of his trade. The second means of support is the attachment of the primary straps to leg straps.

DESCRIPTION OF THE DRAWINGS

The invention can be better understood with reference to the following drawings. The elements of the drawings are not necessarily to scale relative to each other, emphasis instead being placed upon clearly illustrating the principles of the invention. Furthermore, like reference numerals designate corresponding parts throughout the several views.

DETAILED DESCRIPTION

Figure 1:
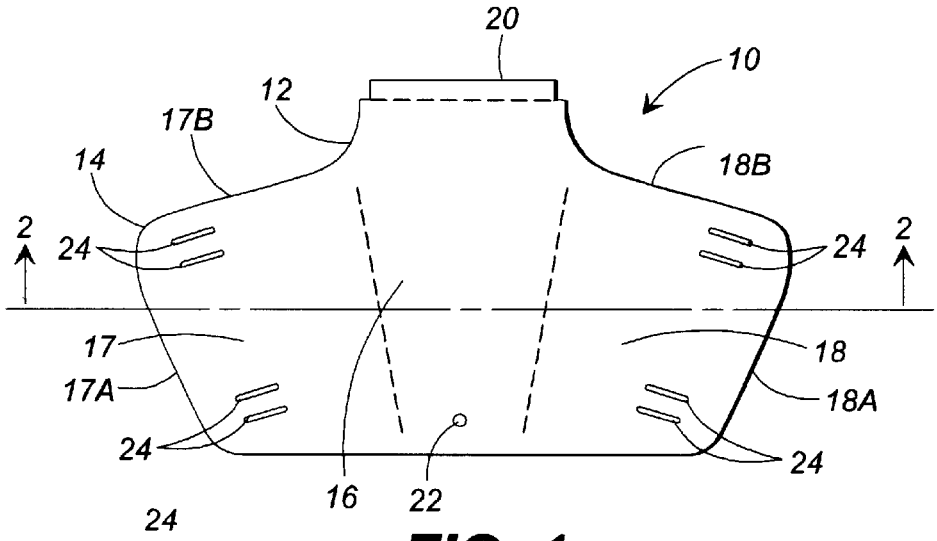
FIG. 1 is a front view of the one-piece headrest embodiment.

Referring now in greater detail to the drawings in which like numerals indicate like parts throughout the several views. FIG. 1 illustrates the one-piece headrest 10 which includes a head support portion 12 and a back mounted support plate 14 joined unitarily together. A unitary construction simplifies manufacture and reduces cost. For simplicity of manufacture, the one-piece headrest 10 is preferably formed from a moldable polymeric material. It will be appreciated by those skilled in the art that the one-piece headrest 10 could be formed by an alternate process, such as casting, pressing or stamping, or the headrest 10 could be made of a different material, such as metal, fiberglass or the like.

The back mounted support plate 14 has a central body portion 16 in vertical alignment with the head support portion 12. Two opposing wing portions 17 and 18 are on opposite sides of the central body portion 16. As shown in FIG. 1, the outside edges 17A and 18A of the wing portions 17 and 18 diverge upwardly and outwardly from each other. The upper edges 17B and 18B of the wing portions 17 and 18 slope upwardly from the wing portion side edges 17A and 18A up to the head support portion 12 so as to approximate the slope of a person's shoulders. However, the shape and size of the back mounted support plate 14 can assume other shapes or sizes which allow adequate contact to the person's upper back so that the necessary comfort and stability is maintained by the headrest 10.

An optional headrest cushion 20, which can be contoured to match the shape of the person's head, may be attached to the head support portion 12. Normally, the padding material of the headrest cushion 20 comprises high density polymeric foam, although it will be appreciated by those skilled in the art that the headrest cushion 20 could alternatively be constructed of any soft, cushioning material suitable for a cushion. Although the headrest cushion 20 would normally be affixed to the head support portion 12 with PVC glue, it will be appreciated by those skilled in the art that various other equivalent attachment methods could be used such as bonding, taping, fastening, threading, sewing, or the like.

Although not essential, a storage hole 22 can be provided on the central body portion 16, or any other convenient location on the head rest 10, for hanging on a wall hook, nail, prong or similar hanging device.

Figure 4:
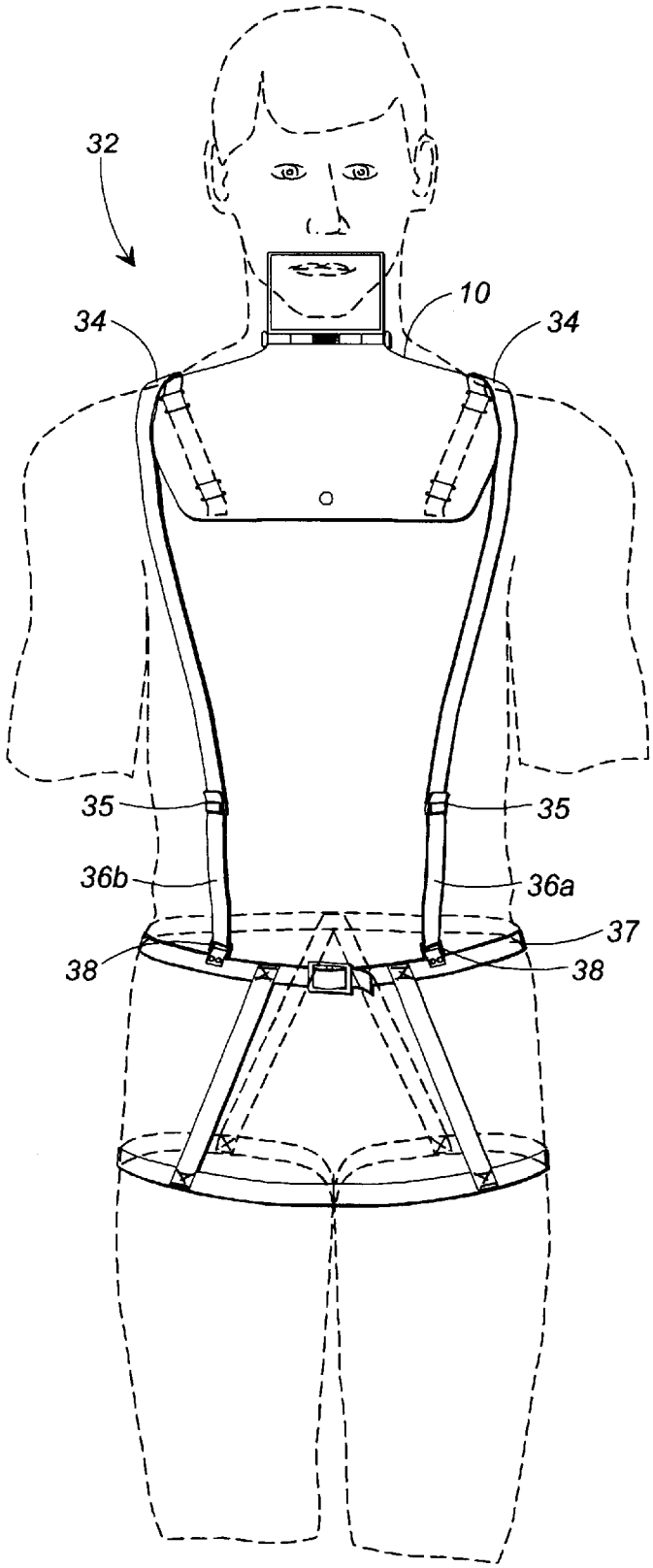
FIG. 4 is a front view of the first strap attachment system embodiment and the one-piece headrest embodiment of FIG. 1 showing the relationship of the headrest and strap attachment system with the person.
Figure 5:
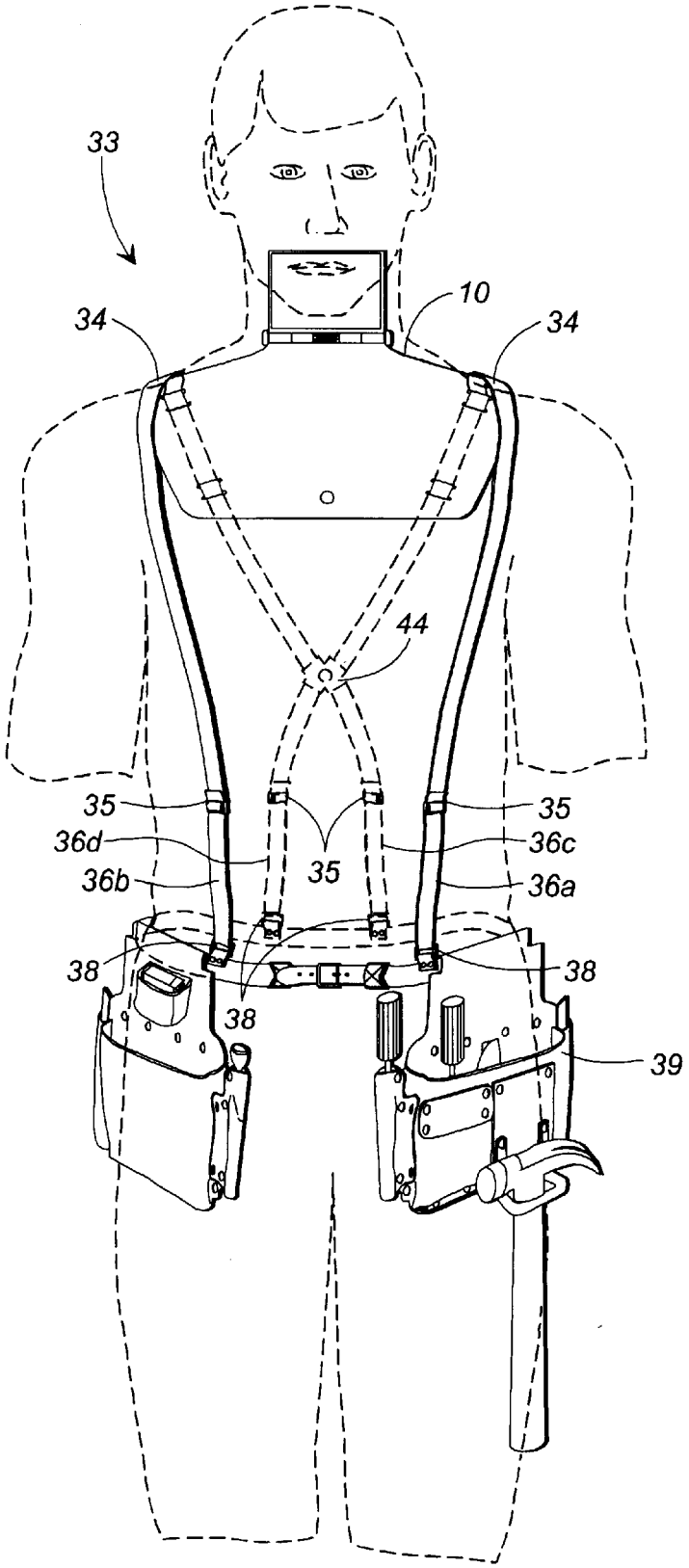
FIG. 5 is a front view of the second strap attachment system embodiment and the one-piece headrest embodiment of FIG. 1 showing the relationship of the headrest and strap attachment system with the person.
Figure 6:
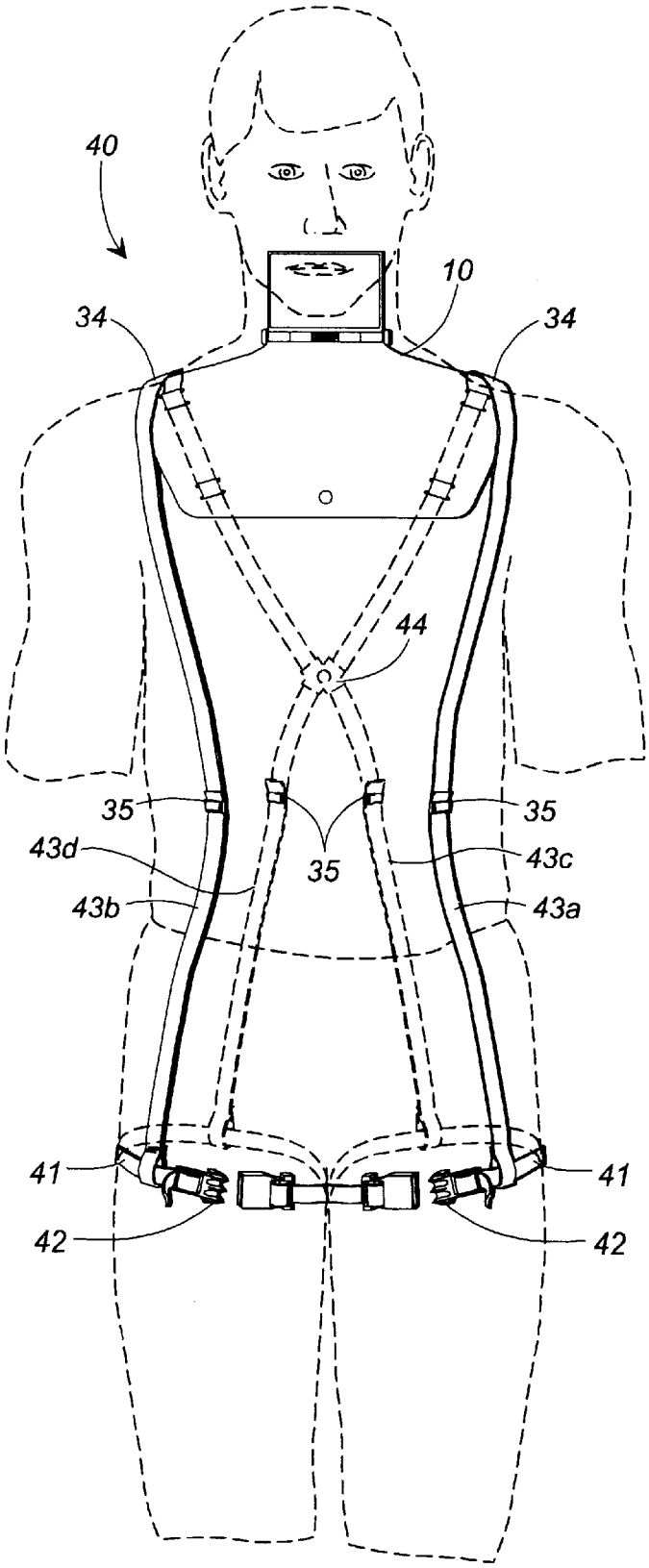
FIG. 6 is a front view of the third strap attachment system embodiment and the one-piece headrest embodiment of FIG. 1 showing the relationship of the headrest and strap attachment system with the person.

A means for attaching the back mounted support plate 14 to the person could include a strap attachment system 32 (see FIGS. 4–6). As shown in FIG. 1, the back mounted support plate 14 includes a plurality of strap slots 24 near each of the outside edges of the wing portions 18. Each strap slot 24 is sufficiently large to accommodate the straps of a strap attachment system (see FIGS. 4–6). Stability of the headrest 10 is improved when the strap slots 24 on the right side wing portion 18 are separated by at least six inches from the strap slots 24 on the left side wing portion 18. One skilled in the art will appreciate that a variety of alternative methods to attach the back mounted support plate 14 to the person could be utilized. Examples of these various alternative attachment methods include cords, belts, brackets, clips, snaps, buttons, snap fasteners or the like. Likewise, stability of the attachment method utilized will be enhanced when the contact points to the back mounted support plate 14 provided by the alternate attachment method have a separation equivalent to the strap slot 24 separation described herein.

Figure 2:
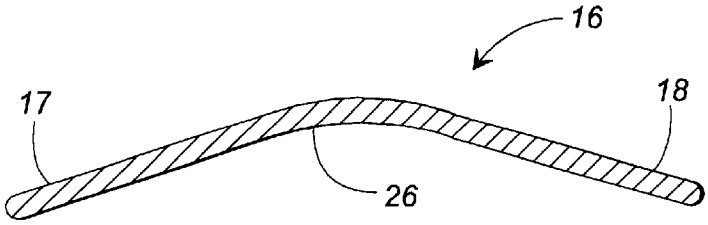
FIG. 2 is a cross sectional view of the back mounted support plate along the 2—2 plane of FIG. 1.

FIG. 2, is a cross section of the back mounted support plate 14 along the plane 2—2 of FIG. 1. The cross sectional view shows an optional contouring of the central body portion 16 so as to have a concave surface 26 to straddle the person's spine. The concave surface provides for a comfortable, secure and stable fit of the back mounted support plate 14 to the person's shoulder blades by providing for a firm contact of the opposing wing portions 17 and 18 to the person's shoulder blades and by minimizing contact with the person's spine. It will be appreciated by those skilled in the art that the contouring of the back mounted support plate 14 can take a variety of shapes and forms, so long as adequate contact to the person's upper back is provided by the back mounted support plate 14 (FIG. 1).

Figure 3:
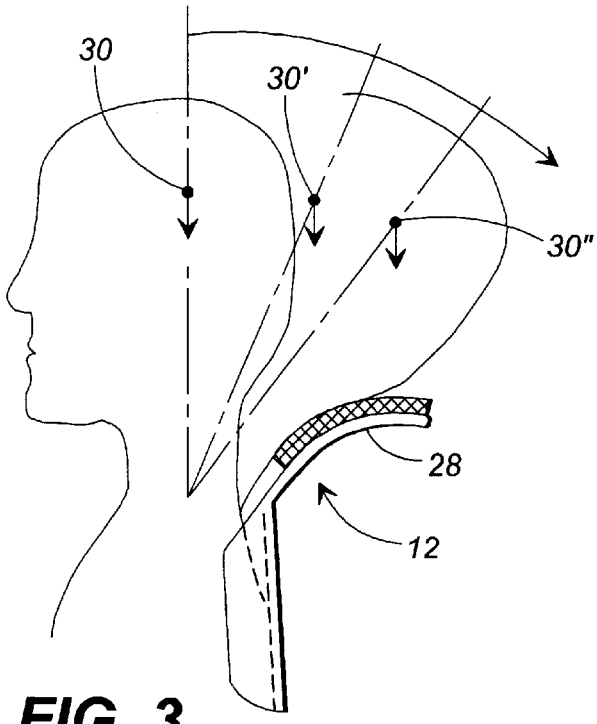
FIG. 3 is a side view of the one-piece headrest embodiment.

When the headrest 10 is attached to the person's upper back as shown in FIG. 3, support to the person's head is provided by the outwardly extending head support portion 12. The head support portion 12 has a backwardly curved surface 28 approximating the arch of the person's neck. When a person is looking forward, the center of gravity 30 of the person's head is above and in approximate vertical alignment with the person's spine. With the person's head in the forward looking position, the weight of the person's head is supported by the spine, much like a column supports the weight of a building roof. However, when the person is looking upwards, the person's head will tilt backwardly and move the person's head out of vertical alignment with the spine. That is, the center of gravity 30 will move from approximately above the spine to a position behind the spine, as shown by the new center of gravity 30', requiring the person's neck muscles to support the weight of the person's head. When the person's head is further tilted to come into contact with the curved surface 28, the weight of person's head becomes supported by the headrest 10 and the center of gravity 30" becomes vertically aligned with the curved surface. The head now comfortably rests on the head support portion 12, thereby reducing stress and fatigue of the person's neck muscles. It will be appreciated by those skilled in the art that the backward curve of the head support portion 12 can be of a variety of alternative shapes, such as, but not limited to, a concave shape or a flat surface, so long as adequate support is provided to the person's head and/or neck by the head support portion 12 while allowing for normal head movements to the left or to the right.

FIG. 4 shows the first embodiment of the strap attachment system 32 consisting of a plurality of straps and fasteners. The strap attachment system 32 is connected to the one-piece headrest 10 by threading the shoulder straps 34 through the strap slots 24 (see FIG. 1) or by means of an alternate attachment method such as sewing, riveting or other fastening methods. The shoulder straps 34 extend upward over the person's shoulders and down front of the torso to a point just above the lower ribs. The strap 34 terminates with a fastener, such as a ladderloc buckle 35 sewn to the shoulder strap 34 ends. Two separate straps, one left 36*a* and one right 36*b* are attached to the belayer's climbing harness 37, such as by means of a spring loaded clipping buckle 38, as is commonly used for suspenders. The other end of straps 36*a* and 36*b* are fed through the fasteners 35 of strap 34 allowing for support and adjust ability of the headrest.

The user of the first strap attachment system 32 embodiment, shown in FIG. 4, will primarily be a belayer, although certain workmen wearing a tool belt may choose to utilize this first embodiment. This first embodiment utilizes the least complicated, easiest to don, and lightest weight design, all of which are of utmost importance to a belayer when situated on a small ledge possibly hundreds of feet above the ground. It should be further noted that this first embodiment does not utilize any attaching devices at the rear of the torso. Due to the nature of the job of belaying, the belayer must stay in one position for the duration of the act of belaying, and the belayer may be secured to the cliff in order to keep from being pulled off his position if the climber falls. Thus, the use of strap attachments only on the front of the person's body facilitates easy attachment. This strap attachment system utilizes the leg straps already incorporated into the belayer's climbing harness 37.

FIG. 5 shows the second embodiment of the strap attachment system 33 consisting of a plurality of straps and fasteners. The strap attachment system 33 is connected to the one-piece headrest 10 by threading the shoulder straps 34 through the strap slots 24 (see FIG. 1). These straps extend upward over the person's shoulders and down the front of the torso to a point just above the person's lower ribs. Straps 34 also extend downward from the one-piece headrest 10 crossing at the person's spine and are secured together by fastener 44. Straps 34 extend further downward to a point just above the lower ribs. These straps terminate with a fastener, such as a ladderloc buckle 35 sewn to both ends of the shoulder straps 34. Four separate straps, one left front 36*a*, one right front 36*b*, one left back 36*c* and one right back 36*d* are attached to the workman's tool belt 39, such as by means of a spring loaded clipping buckle 38 as is commonly used for suspenders at one end. The other end of the straps 36*a*, 36*b*, 36*c* and 36*d* are fed through the fasteners 35 of strap 34 allowing for support and adjustability of the headrest. This strap attachment system utilizes the counterbalance weight of the workman's tools held by the workman's tool belt 39 as a means of support.

The user of the second strap attachment system 33 embodiment shown in FIG. 5 will primarily be a workman wearing a tool belt, although certain belayers may choose to use this embodiment. Similar to the first embodiment, this second embodiment of the strap attachment system 33 includes the addition of straps 36*c* and 36*d* attached to the shoulder straps 34 at the rear of the person's torso. These straps 36*c* and 36*d* stabilize the headrest 10 when the user is mobile so as to keep the headrest 10 from moving out of position when the user moves about. Support for the headrest 10 is accomplished by attachment of the connecting straps 36*a*–36*d* to the worker's tool belt. Alternatively, support may be accomplished with this embodiment if a belayer chooses to attach straps 36*c* and 36*d* to his belayer's harness 37 (FIG. 5).

FIG. 6 shows a third embodiment of the strap attachment system 40 consisting of a plurality of straps and fasteners. The strap attachment system 40 is connected to the one-piece headrest 10 by threading the shoulder straps 34 through the strap slots 24 (see FIG. 1). These straps extend upward over the person's shoulders and down the front of the torso to a point just above the person's lower ribs. Straps 34 also extend downward from the one-piece headrest 10 crossing at the person's spine and are secured together by fastener 44. Straps 34 extend further downward to a point just above the person's lower ribs. These straps 34 terminate with a fastener, such as a ladderloc buckle 35 sewn to both ends of the shoulder straps 34. This embodiment utilizes two leg straps 41. Fasteners, such as slide release buckles 42, are attached to the end of strap 41. Straps 41 are looped around the person's upper thigh and adjusted for comfortable fit. This embodiment utilizes four connecting straps, 43*a*, 43*b*, 43*c* and 43*d*, each with a loop sewn at one end. Leg straps 41 are each passed through the loop ends of two connecting straps 43*a* and 43*c*, and 43*b* and 43*d*. The other end of straps 43*a*–43*d* are connected to straps 34 allowing for support and adjust ability of the headrest.

The user of the third strap attachment system 40 embodiment shown in FIG. 6 could be either a workman not wearing a tool belt or a physically impaired person lacking motor skills controlling head position. Support of the headrest 10 is accomplished with the use of additional leg straps 41 and straps 43*a*–43*d*.

Figure 7:
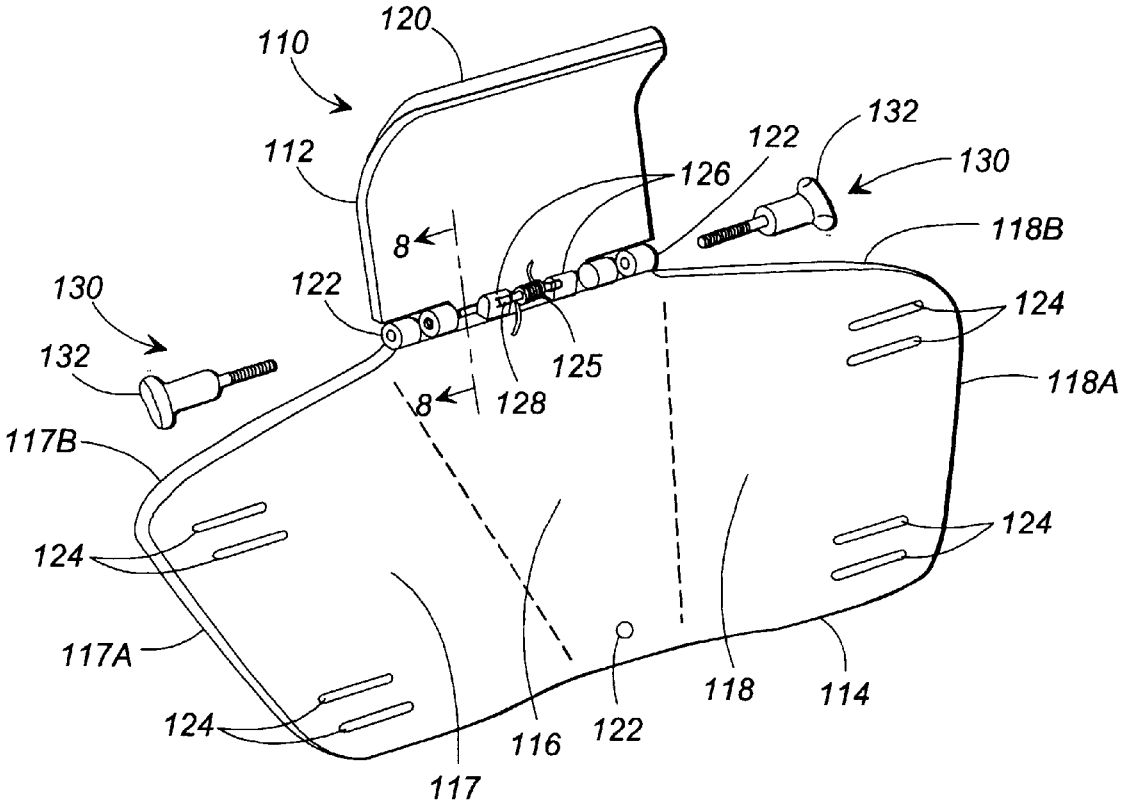
FIG. 7 is a back perspective view of the two-piece adjustable headrest embodiment.

An alternative headrest embodiment is shown in FIG. 7, a two-piece adjustable headrest 110, which is constructed in accordance with the present invention. FIG. 7 is a back perspective view of the two-piece adjustable headrest 10. The two-piece adjustable headrest 110 serves the same purposes as the one-piece headrest 10 (see FIG. 1), to provide head support to reduce stress and fatigue of the person's neck. The two-piece adjustable headrest 110 may be substantially similar in construction to that of the one-piece headrest 10. Therefore, the following disclosure will briefly describe the components of the two-piece adjustable headrest 110. A more detailed description is reserved only for structures or features specific to the two-piece adjustable headrest 110 alone.

Similar to the one-piece headrest 10, the two-piece adjustable headrest 110 has a head support portion 112 and a back mounted support plate 114. The back mounted support plate 114 has a central body portion 116 in vertical alignment with the head support portion 112. Two opposing wing portions 117 and 118 are on opposite sides of the central body portion 116. As shown in FIG. 7, the outside edges 117A and 118A of the wing portions 117 and 118 diverge upwardly and outwardly from each other. The upper edges 117B and 118B of the wing portions 117 and 118 slope upwardly from the wing portion side edges 117A and 118A up to the head support portion 112 so as to approximate the slope of a person's shoulders. However, the shape and size of the back mounted support plate 114 can assume other shapes or sizes which allow adequate contact to the person's upper back so that the necessary comfort and stability is maintained by the headrest 10.

The central body portion 116 may have an optional concave surface (see FIG. 2) to straddle the person's spine. The concave surface provides for a comfortable, secure and stable fit of the back mounted support plate 114 to the person's shoulder blades by providing for a firm contact of the opposing wing portions 118 to the person's shoulder blades and by minimizing contact with the person's spine. An optional headrest cushion 120 may be attached to the head support portion 112. Finally, an optional storage hole 122 can be provided on the back mounted support plate 114 for hanging on a wall hook, nail, prong or similar hanging device.

Likewise, the strap systems shown in FIGS. 4–6 could be used to attach the back mounted support plate 114 to the person's back. As shown in FIG. 7, a plurality of strap slots 124 are located near each of the outside edges of the wing portions 118. The stability of the headrest 110 is improved when the strap slots 124 on the right side wing portion 118 are separated by at least six inches from the strap slots 124 on the left side wing portion 118.

The two-piece adjustable headrest 110 incorporates a significant difference from the one-piece headrest 10; a separate, biased head support portion 112 with a locking mechanism. Shaped similarly to the one-piece headrest 10 head support portion 12, the head support portion 112 can pivot in relation to the back mounted support plate 114. The person may use a locking mechanism to secure the head support portion 112 in a fixed position, or the head support portion 112 may be allowed to freely pivot so that contact can be maintained with the person's head over a continuous angle range of backwardly tilted head positions. This feature could be particularly advantageous to physically impaired persons who lack the ability to support the head and must maintain a to specific head/neck angle for comfort or must periodically alter this angle so as to reduce fatigue and stiffening of the neck.

The two-piece adjustable headrest 110 embodiment shown in FIG. 7 uses two hinges 122 to connect the head support portion 112 to the back mounted support plate 114, and to allow the head support portion 112 to pivot about the back mounted support plate 114. Those skilled in the art will appreciate that the head support portion 112 could alternatively be connected to the back mounted support plate 114 by any plurality of hinges. Those skilled in the art will appreciate that another type of connection device such as a resilient flap, wire or clip could be used to provide for an equivalent connection.

Biasing the head support portion 112 and the back mounted support plate 114 urges the head support portion 112 toward the person's head. Biasing is an option providing for a constant measure of supportive force to the person's head. For the two-piece adjustable headrest 110 embodiment shown in FIG. 7, biasing is provided by a torsion spring 125. The torsion spring 125 is secured to the headrest 110 by two torsion spring brackets 126. A pin 128 provides a simple means to hold the torsion spring 125 in position. Those skilled in the art will appreciate that any type of biasing means, such as a flexible resilient member composed of metal, plastic or similar material, which urges the head support portion 112 toward the person's head, could be used.

Another optional feature is a locking mechanism consisting of a threaded fastener 130 in combination with a hinge 122. This locking mechanism allows the person to select and fix the position of the head support portion 112. The two-piece adjustable headrest 110 as shown in FIG. 7 utilizes two locking mechanisms, however one locking mechanism may suffice. Those skilled in the art will appreciate that any type of locking mechanism which performs the function of locking the head support portion 112 in a fixed position could be used.

Figure 8:
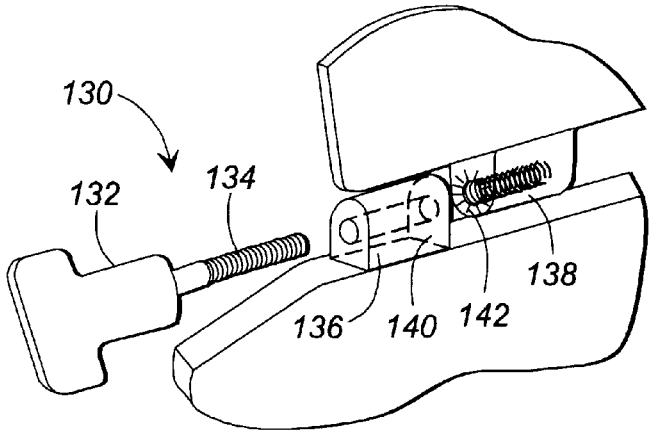
FIG. 8 is a detailed back perspective view to the left of plane 8—8 of FIG. 7 showing the threaded fastener, locking mechanism and hinge.

The locking mechanism is shown in greater detail in FIG. 8, which is a close up view of the two-piece adjustable headrest 110 to the left of plane 8—8 of FIG. 7. Each threaded fastener 130 is comprised of a finger knob 132, such as a wing nut or the like, and a threaded screw 134. The screw 134, being long enough to pass through the unthreaded hinge piece 136 into the hinge piece 138, has threads for screwing into the hinge piece 138. The aperture of the hinge piece 136 is smooth and has an aperture diameter greater than the screw 134 diameter. The aperture of the hinge piece 138 is threaded so as to mate with the screw 134. When the threaded fastener 130 is tightened by the person rotating the finger knob 132, frictional forces developing on the various contacting surfaces of the hinge mechanism and the threaded fastener 130 locks the head support portion 112 in a fixed position. When the person untightens the threaded fastener 130, biasing urges the head support portion 112 toward the person's head to provide support over a continuous angle range of backwardly tilted head positions.

An enhancement of the locking mechanism is illustrated in FIG. 8. Irregular shapes are located on the opposing hinge surfaces 140 and 142. When the threaded fastener 130 is tightened, the opposing surfaces 140 and 142 are squeezed together to come into contact, thereby creating substantial frictional forces such that the position of the head support portion 112 is securely fixed. For illustrative purposes, the high friction hinge surfaces 140 and 142 are of a plurality of small ridges 142. Additionally, those skilled in the art will appreciate that a resilient locking washer, such as a nylon washer, rubber washer, or metal lock washer, could be substituted for the irregular shaped high friction surfaces, wherein the tightening effect of the threaded fastener 130 would compress the washer into a locking position.

It would be apparent to one skilled in the art that many variations and modifications may be made to the preferred embodiment as described above without substantially departing from the principles of the present invention. All such variations and modifications are intended to be included herein and are within the scope of the present invention, as set forth in the following claims.

What is claimed is:

1. A headrest for supporting a person's head, comprising:

a back mounted support plate, said back mounted support plate adapted to fit to the person's back and having a central body portion, a right wing portion and a left wing portion;

a head support portion adapted to support the person's head, said head support portion connected to said back mounted support plate and extending outwardly therefrom; and means for attaching said back mounted support plate to the person, wherein said back mounted support plate and said head support portion are formed unitarily together, said central body portion including a concave surface straddling the person's spine to increase comfort, reduce movement of said headrest, and increase stability of said back mounted support plate when attached to the person's back.

2. The headrest of claim 1, wherein said head support portion curves backwardly to approximate the arch of the person's neck.

3. The headrest of claim 1, wherein said head support portion includes a headrest cushion attached to said head support portion.

4. A headrest for supporting a person's head, comprising:

a back mounted support plate, said back mounted support plate adapted to fit to the person's back and having a central body portion, a right wing portion and a left wing portion;

a head support portion adapted to support the person's head, said head support portion connected to said back mounted support plate and extending outwardly therefrom; and means for attaching said back mounted support plate to the person, wherein said back mounted support plate and said head support portion are formed unitarily together, a plurality of strap slots formed in said back mounted support plate;

a strap attachment system having a plurality of straps and at least one fastener;

wherein said headrest is attachable to the person's back with said strap attachment system, said straps passing through said strap slots and around the person's shoulders, and said fastener allowing the person to adjust tension of said straps so as to provide a secure fit of said back mounted support plate to the person's back.

5. The headrest of claim 4, wherein at least one of said strap slots is located on said right wing portion and at least one of said strap slots is located on said left wing portion, said at least one strap slots on said right wing portion being separated by at least six inches from said at least one strap slots on said left wing portion, so as to improve the stability of said back mounted support plate when attached to the person's back.

6. The headrest of claim 4, wherein said strap attachment system includes two leg straps.

7. The headrest of claim 4, wherein said strap attachment system attaches to a belt.

8. The headrest of claim 4, wherein said strap attachment system attaches to a belayer's climbing harness.

9. An adjustable headrest for supporting a person's head, comprising:

a head support portion adapted to support the person's head, said head support portion having a bottom edge wherein said head support portion extends outwardly from said bottom edge;

a back mounted support plate, said back mounted support plate having a central body portion, a right wing portion and a left wing portion;

means for attaching said head support portion to said back mounted support plate, such that said head support portion is pivotable in relation to said back mounted support plate so that contact can be maintained with the person's head;

means for urging said head support portion toward the person's head; and means for attaching said back mounted support plate to the person, wherein said headrest provides comfortable head support to the person over a continuous angle range of backwardly tilted head positions.

10. The headrest of claim 9, wherein said central body portion includes a concave surface straddling the person's spine to increase comfort, reduce movement of said headrest, and increase stability of said back mounted support plate when attached to the person's back.

11. The headrest of claim 9, wherein said head support portion curves backwardly from said bottom edge to approximate the arch of the person's neck.

12. The headrest of claim 9, wherein said head support portion includes a headrest cushion attached to the said head support portion.

13. The headrest of claim 9, further including a locking mechanism, wherein said locking mechanism enables the person to fix the position of said head support portion relative to said back mounted support plate.

14. An adjustable headrest for supporting a person's head, comprising:

a back mounted support plate, said back mounted support plate adapted to fit to the person's back, having a central body portion with a top edge, a right wing portion and a left wing portion;

a head support portion, said head support portion adapted to support the person's head and having a bottom edge, wherein said head support portion extends outwardly from said bottom edge;

a biased hinge mechanism, said hinge mechanism connecting said top edge of said central body portion to said bottom edge of said head support portion;

a locking mechanism, wherein said locking mechanism enables the person to fix the position of said head support portion relative to said back mounted support plate;

a strap attachment system having a plurality of straps and at least one fastener; and a plurality of strap slots formed in said right wing portion and in said left wing portion, wherein said headrest is attachable to the person's back with said strap attachment system, said straps passing through said strap slots and around the person's shoulders, and said fastener allowing the person to adjust tension of said straps so as to provide a secure fit of said back mounted support plate to the person's back.

15. The headrest of claim 14, wherein at least one of said strap slots is located on said right wing portion and at least one of said strap slots is located on said left wing portion, said at least one strap slots on the right wing portion being separated by at least six inches from said at least one strap slots on the left wing portion, so as to improve the stability of said back mounted support plate when attached to the person's back.

16. The headrest of claim 14, wherein said strap attachment system includes two leg straps.

17. The headrest of claim 14, wherein said strap attachment system attaches to a belt.

18. The headrest of claim 14, wherein said strap attachment system attaches to a belayer's climbing harness.

19. The headrest of claim 14, wherein said central body portion includes a concave surface straddling the person's spine to increase comfort, reduce movement of said headrest, and increase stability of said back mounted support plate when attached to the person's back.

20. The headrest of claim 14, wherein said head support portion includes a headrest cushion attached to said head support portion.

21. The headrest of claim 14, wherein said locking mechanism and said biased hinge mechanism are integrated into a unitary biased, lockable hinge mechanism.

22. The headrest of claim 14, wherein said locking mechanism includes at least one threaded fastener that threads into said hinge mechanism to releasably affix said back mounted support plate and said head support portion together to lock position of said head support portion.

23. The headrest of claim 22, wherein said hinge mechanism having opposing high friction surfaces, wherein said high friction surfaces rigidly lock together when urged together by tightening of said threaded fastener to said hinge mechanism.

24. The headrest of claim 22, wherein said locking mechanism further comprising a locking washer, such that said locking washer that is oriented between at least one threaded fastener having a friction surface and said hinge mechanism having an opposing friction surface so as to rigidly lock together sa id locking washer when said opposing friction surfaces are urged together by tightening of said threaded fastener to said hinge mechanism.

25. The headrest of claim 14, wherein said head support portion curves backwardly from said bottom edge to approximate the arch of the person's neck.

26. A method for supporting a person's head, comprising the steps of: attaching a head support portion to a back mounted support plate such that the head support portion pivots in relation to the back mounted support plate so that contact is maintained with the person's head;

urging the head support portion toward the person's head; and attaching the back mounted support plate to the person by a strap attachment with straps extending through left and right wing portions of the support plate, wherein the headrest provides comfortable head support to the person over a continuous angle range of backwardly tilted head positions.

27. A headrest for supporting a person's head, comprising:

a back mounted support plate, said back mounted support plate adapted to fit to a person's back and having a central body portion, a right wing portion and a left wing portion;

a head support portion adapted to support a person's head, said head support portion connected to said back mounted support plate and extending outwardly therefrom;

a plurality of strap slots formed in each of said right wing portion and said left wing portion;

a strap attachment system having a plurality of straps, with one of said straps extending through the strap slots of said right wing portion and another one of said straps extending through the slots of said left wing portion;

wherein said head rest is attachable to a person's back with said strap attachment system, said straps passing through said strap slots and around the person's shoulders and attached to the person so as to provide a secure attachment of said back mounted support plate to the person's back.

* * * * *